US006589033B1

(12) United States Patent
Johnson et al.

(10) Patent No.: US 6,589,033 B1
(45) Date of Patent: Jul. 8, 2003

(54) UNITARY SLIDING VANE COMPRESSOR-EXPANDER AND ELECTRICAL GENERATION SYSTEM

(75) Inventors: Mark C. Johnson, Phoenix, AZ (US); Eric R. Miller, Phoenix, AZ (US); Jason L. Addink, Phoenix, AZ (US); Jorge L. Rosales, Glendale, AZ (US); Bradley B. Rogers, Chandler, AZ (US)

(73) Assignee: Phoenix Analysis and Design Technologies, Inc., Tempe, AZ (US)

( * ) Notice: Subject to any disclaimer, the term of this patent is extended or adjusted under 35 U.S.C. 154(b) by 0 days.

(21) Appl. No.: 09/678,368

(22) Filed: Sep. 29, 2000

(51) Int. Cl.[7] ..... F04C 11/00

(52) U.S. Cl. ..... 418/13; 418/82; 418/152; 418/158; 418/179; 418/268; 429/34; 429/26; 429/17; 429/13; 60/419; 62/116; 62/402; 62/498

(58) Field of Search ..... 418/13, 152, 179, 418/158, DIG. 1, 82, 268; 429/34, 26, 13, 17; 62/116, 498, 402; 60/419

(56) References Cited

U.S. PATENT DOCUMENTS

| | | | | |
|---|---|---|---|---|
| 2,250,947 A | | 7/1941 | Carpenter, Jr. | |
| 2,670,895 A | | 3/1954 | Steensen | |
| 2,952,249 A | * | 9/1960 | Conover, Jr. | 418/152 |
| 3,686,893 A | * | 8/1972 | Edwards | 418/86 |
| 3,790,314 A | | 2/1974 | Swain et al. | |
| 3,900,277 A | | 8/1975 | Newton | |
| 3,913,351 A | * | 10/1975 | Edwards | 62/402 |
| 3,936,246 A | | 2/1976 | Beitzel | |
| 3,967,466 A | * | 7/1976 | Edwards | 62/402 |
| 4,088,426 A | | 5/1978 | Edwards | |
| 4,109,486 A | | 8/1978 | Sieck | |
| 4,132,512 A | | 1/1979 | Roberts | |
| 4,187,693 A | | 2/1980 | Smolinski | |
| 4,331,223 A | | 5/1982 | Charlat et al. | |
| 4,384,828 A | | 5/1983 | Rembold et al. | |
| 4,492,541 A | * | 1/1985 | Mallen-Herrero et al. | 418/219 |
| 4,657,829 A | | 4/1987 | McElroy et al. | |
| 4,672,813 A | | 6/1987 | David | |
| 4,806,085 A | | 2/1989 | Costa | |
| 4,934,912 A | | 6/1990 | Iio et al. | |

(List continued on next page.)

*Primary Examiner*—Thomas Denion
*Assistant Examiner*—Theresa Trieu
(74) *Attorney, Agent, or Firm*—James L. Farmer

(57) ABSTRACT

The present invention provides a unitary sliding-vane type compressor-expander comprising a housing with a compressor inlet and outlet, and an expander inlet and outlet. A single rotor is disposed therein defining in cooperation with the housing a compression chamber on one side and an expansion chamber on the opposite side. The rotor includes a plurality of regularly spaced vanes slidingly disposed in slots about the periphery of the rotor. The bottoms of the vane slots may be vented through a passage in the housing to the inlet air, or alternatively through a groove between the vane and vane slot to the compression or exhaust chambers. Permanent magnets are used in the vanes and housing to increase or decrease the contact force between the vane tip and housing. An integral condenser-humidifier is provided in the path of the expanded gas exhausting from the turbine outlet for condensing water out of the expanded gas and returning the condensed water to the compressor-expander. The integral condenser may comprise a substantially vertically oriented spout or an internal chamber. In another embodiment of the invention an electrical generation system is provided comprising a unitary sliding vane type compressor-expander in combination with a fuel cell. The compressor portion of the compressor-expander provides compressed air to an oxidant inlet of the fuel cell, and the spent oxidant exhaust from the fuel cell is expanded through the expander portion of the compressor-expander.

27 Claims, 8 Drawing Sheets

U.S. PATENT DOCUMENTS 5,524,587 A * 6/1996 Mallen et al. ..... 418/263
5,540,199 A 7/1996 Penn
5,595,833 A 1/1997 Gardner et al.
5,645,950 A * 7/1997 Benz et al. ..... 429/13
5,681,153 A 10/1997 Weatherston
5,769,617 A 6/1998 Glen
5,819,554 A 10/1998 Glen
5,855,474 A 1/1999 Shouman
5,900,330 A * 5/1999 Kagatani ..... 429/17
5,981,096 A 11/1999 Hornburg et al.
6,024,859 A 2/2000 Hsu
6,063,515 A 5/2000 Epp et al.

* cited by examiner

UNITARY SLIDING VANE COMPRESSOR-EXPANDER AND ELECTRICAL GENERATION SYSTEM

TECHNICAL FIELD

The present invention generally relates to compressors and expanders, and more particularly, to a unitary rotary sliding vane type compressor and expander for use in conjunction with a Proton Exchange Membrane (PEM) fuel cell.

BACKGROUND OF THE INVENTION

The present invention, although not limited to any particular application, arose from a lack in the prior art of a satisfactory compressor and expander for use in conjunction with a modem, very small, highly efficient fuel cell. Fuel cells generate electricity as a result of electrochemical interactions that occur inside the fuel cell between a fuel such as hydrogen and an oxidant such as air. Such fuel cells have an anode space and a cathode space which are separated from one another by a proton exchange membrane. Electricity is generated when oxidant is introduced to the cathode space and fuel is introduced to the anode space. Hydrogen fueled fuel cells are disclosed, for example, in U.S. Pat. Nos. 5,645,950, 4,657,829, and also in U.S. Pat. No. 6,124,051 (hereinafter the 051 patent), assigned to the assignee of the present invention. The '051 patent is incorporated herein in relevant part by reference.

It is known in certain industrial and in the automotive art to improve the operating efficiency of fuel cells by pre-compressing the oxidant gas entering the fuel cell, while expanding the spent oxidant gas exhausted from the fuel cell. Such prior art systems have typically utilized high-speed impellers, or other turbomachinery or turbocharger-like compressors and turbines for this purpose. Systems for pre-compressing and then expanding the fuel cell oxidant are disclosed, for example, in U.S. Pat. Nos. 4,657,829, 5,645,950, 5,981,096, among others. However, fuel cells of ever smaller size are being developed for applications requiring much lighter weight, much more compact, and more efficient electrical generation systems. Illustrative of a small, efficient fuel cell suitable for such applications is the fuel cell disclosed in the '051 patent. In such smaller systems it becomes necessary to also scale down the size of the prior art compressors and turbines to satisfy size and weight constraints imposed by the system requirements. The inventors of the present invention have discovered that as a consequence, it would be necessary to operate scaled down prior art compressors and turbines at excessively high rotational speeds to provide an adequate volume flow, resulting in dynamic unbalance problems. In addition, the efficiency of prior art turbomachine type compressors and turbines drops off dramatically below a certain volume flow rate. The inventors further discerned and discovered that dynamic unbalance and loss of efficiency could preclude the practical application of the prior art compressors and turbines in small and lightweight electrical generation systems.

It is also known in the prior art to improve the operating efficiency of a fuel cell by pre-humidifying the oxidant gas flow entering the fuel cell. For example, in U.S. Pat. No. 5,645,950 is described a system in which product water that is contained in the process air after it has passed through the fuel cell is separated by one or more liquid separators from an air discharge line, and collected in a storage container. The water required for humidifying is then drawn from the container and injected into the fuel cell air supply line. Although perhaps suitable for prior art applications, such separating and humidifying devices are prohibitively heavy and complex for use in conjunction with a small fuel cell of the type previously described.

Accordingly a need exists for a suitable compact, simple, and lightweight compressor and expander for use in conjunction with a fuel cell. Another need exists for a suitable small size and lightweight device for pre-humidifying the oxidant gas flow to a fuel cell.

SUMMARY OF THE INVENTION

In one embodiment of the invention, a unitary compressor-expander is provided comprising a housing having a compressor side with a compressor intake and a compressor outlet, and a turbine side with a turbine intake and a turbine exhaust. A cylindrical rotor is disposed within the housing with a plurality sliding vanes disposed in slots around an outer periphery thereof, wherein the vanes are configured to slide outwardly along the slots upon rotation of the rotor, and sealingly contact an inner contoured surface of the housing. The bottom of a vane slot may be vented through a passage in a cover plate to at least one neighboring vane slot bottom, and to the compressor intake manifold. Alternatively the vane slot bottoms may be vented by a groove between the vane and vane slot to the compression or exhaust chambers.

In another embodiment of the invention a magnet is inserted in at least one of the vanes, and at least one stationary magnet is disposed in the housing about the inner contacting surface. The poles of the stationary magnets may be preferentially oriented so as to attract or repel the vane mounted magnets, thereby increasing or decreasing the contact force between the vane tip and housing. A ferrous metal insert may be used in the vanes instead of a magnet, in which case the stationary magnets can be used to increase the force of the blade tip against the housing where desired.

In another embodiment of the invention an integral condenser-humidifier is disposed in the path of the expanded gas exhausting from the turbine outlet, for condensing water out of the expanded gas and returning the condensed water to the compressor-expander. The integral condenser may comprise a substantially vertically oriented spout or an internal chamber positioned to allow condensed water to drain back into the turbine exhaust manifold and into the path of the vanes. The vanes carry the water over to the compressor portion of the compressor-expander, thereby humidifying the compressed air and improving the sealing of the contacting surfaces therein.

In yet another embodiment of the invention an electrical generation system is provided comprising a unitary sliding vane type compressor-expander and a fuel cell. The compressor portion of the compressor-expander provides compressed air to the oxidant inlet of the fuel cell, and the spent oxidant gas exhausted from the fuel cell is expanded across the expander portion of the unitary compressor-expander. An integral condenser-humidifier may be provided in the path of the expanded gas exhausting from the expander outlet for condensing water out of the expanded gas and returning the condensed water to the compressor-expander. The condensed water lubricates and seals the unitary vane compressor-expander and humidifies the fuel cell, improving the efficiency of both.

BRIEF DESCRIPTION OF THE DRAWING FIGURES

The present invention will hereinafter be described in conjunction with the appended drawing figures, wherein like numerals denote like elements, and:

DETAILED DESCRIPTION OF THE PREFERRED EMBODIMENT

Figure 1:
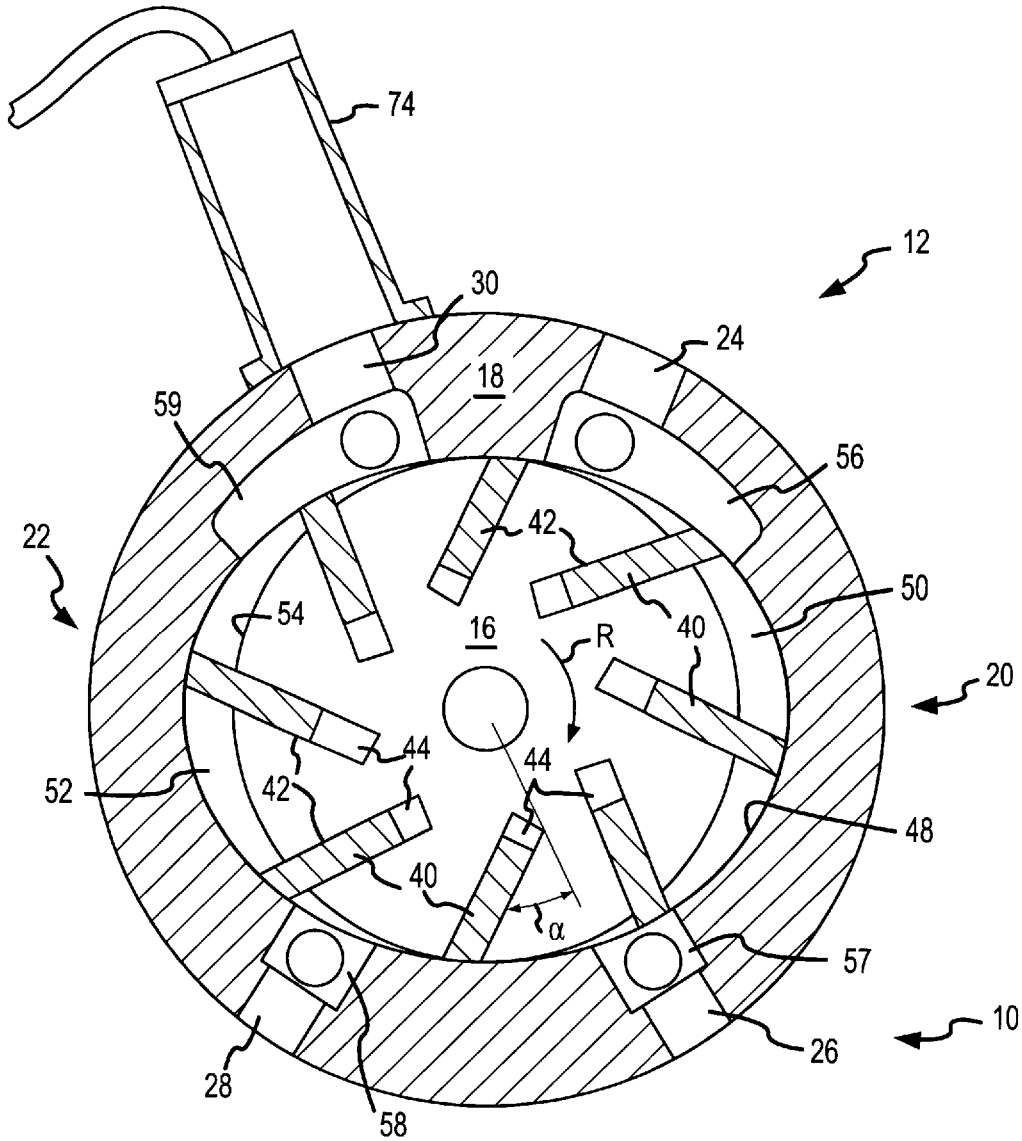
FIG. 1 is a cross-sectional view of an exemplary unitary sliding vane type compressor-expander embodying the present invention.

A vane compressor-expander according to embodiments of the present invention will be described below with reference to the drawing figures. Although the subject invention is described herein in conjunction with the appended drawing figures, it will be appreciated that the scope of the invention is defined entirely by the claims, and not limited to the specific embodiments shown and described. One skilled in the art will recognize that various modifications in the selection and arrangement of parts, components, and processing steps may be made without departing from the spirit and scope of the invention as set forth in the appended claims.

Sliding vane type compressors and expanders are well known in the refrigeration and air conditioning arts. For example, U.S. Pat. No. 3,904,327 describes a rotary unitary compressor-expander for use as a refrigeration device. Other sliding-vane type compressors and expanders are also disclosed in U.S. Pat. Nos. 4,088,426, 4,109,486, 4,672,813, just to name a few. The inventors of the present invention discovered, however, that a positive displacement type compressor and expander, such as a sliding vane type, could be beneficially utilized to provide a sufficient volume flow of oxidant gas to a fuel cell in a small and efficient electrical generation system, while operating at a greatly reduced speed as contrasted with prior art turbomachinery type compressor and expander systems.

Figure 2:
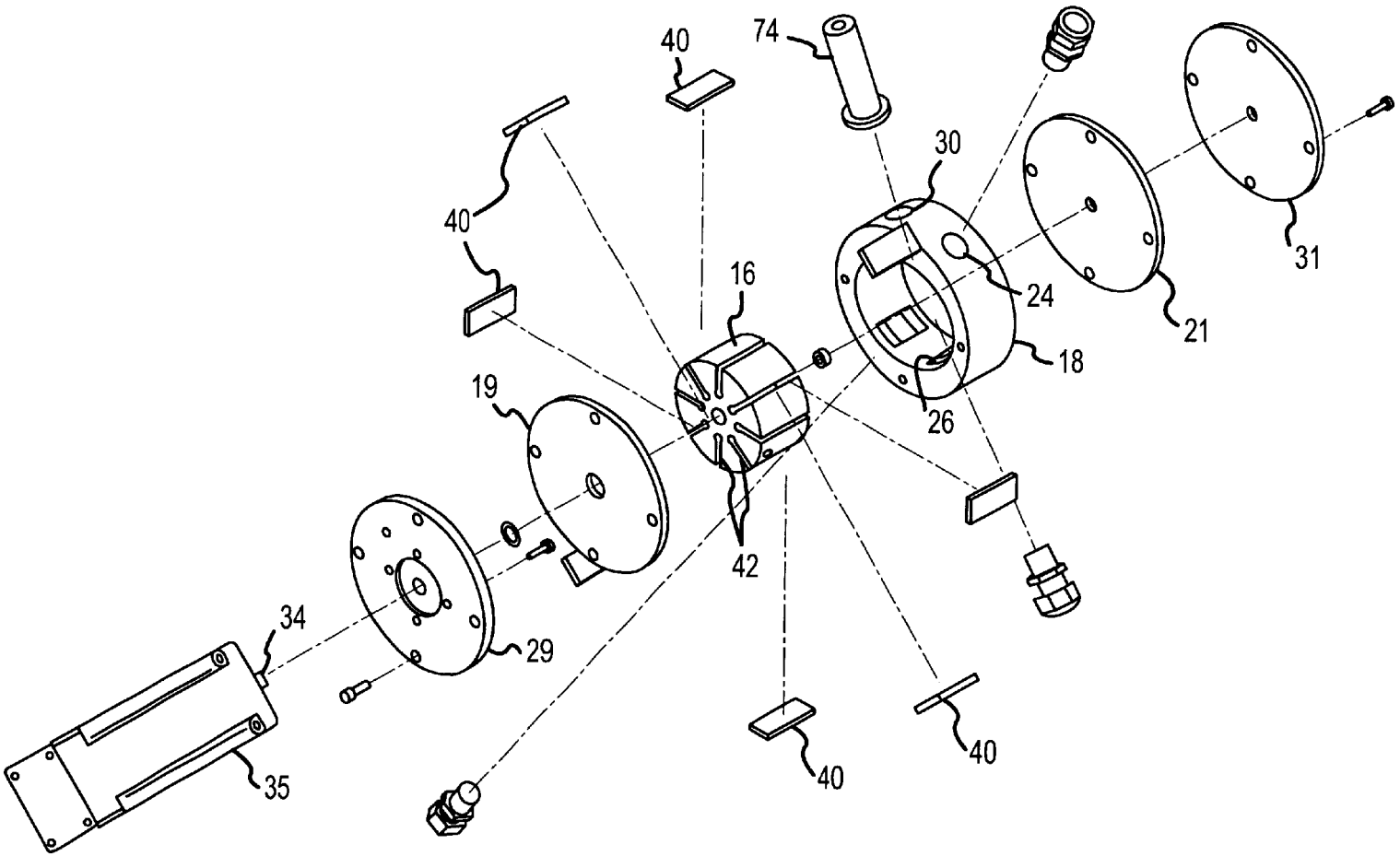
FIG. 2 is an exploded perspective view of the unitary sliding vane type compressor-expander embodiment shown in FIG. 1.

In FIGS. 1 and 2 is shown a unitary sliding-vane type compressor-expander 12 in accordance with a preferred embodiment of the present invention. The compressor-expander 12 uses a single rotor 16 mounted for rotation within a housing 18. The rotor 16 and housing 18 together define a compressor side 20, and an expander (or turbine) side 22 of the compressor-expander 12. The housing 18 has compressor inlet port 24 and a compressor outlet port 26 on the compressor side 20, and an expander intake port 28 and an expander exhaust port 30 on the expander side 22. The rotor 16 is cylindrical in shape, and is mounted for rotation to housing 18 via a shaft 34 and bearings (not shown). The housing and rotor may both be made of aluminum, stainless steel, ceramic, or other suitable material with adequate strength and corrosion resistance. In the case of aluminum, an anodize coating, or teflon-impregnated anodize may be beneficially used. Disposed against opposing faces of rotor 16 are a pair of seal plates 19 and 21, and cover plates 29 and 31. The cover plate 29 serves as a mount for high speed electric motor 35, used to rotate the shaft 34 and thereby rotor 16. The cover plates 29 and 31 are also made of metal such as stainless steel or aluminum. A plurality of sliding vanes 40 are disposed in respective slots 42 formed about the periphery of the rotor 16. The vanes 40, and also the seal plates 19 and 21, are preferably made of a lightweight material with good sliding friction properties such as graphite, carbon, carbon-graphite composite, or various ceramic materials. Preferably a hardened graphite material is used, such as hardened graphite P658RCH, available from Morgan Advanced Materials and Technology Inc. in Ann Arbor Mich. The slots 42 are preferably longer than the vanes 40, thereby creating an empty pocket 44 at the base of each vane 40 at all rotational positions of the rotor 16. The slots 42 may be oriented so that vanes 40 slide along a radial direction of rotor 16, or alternatively oriented at an angle a with respect to the radial direction as depicted in FIG. 1.

The vanes 40 are free to slide outward in slots 42 and contact an inner contacting surface 48 of the housing 18. The inner surface 48 of housing 18 has an elongated shape, thereby defining tapered compression and expansion chambers 50 and 52 between the inner contacting surface 48 of housing 18 and the outer periphery surface 54 of rotor 16. Looking for example at the compressor side 20, the compression chamber 50 tapers from a minimum width adjacent the compressor inlet port 24, to a maximum width at a point approximately mid-way between the inlet port 24 and compressor outlet port 26, and back to a minimum width adjacent the outlet port 26. A similar taper arrangement is defined by the expansion chamber 52 on the turbine side 22. An integral compressor inlet manifold 56 provides a passage from the compressor inlet port 24 to the tapered compression chamber 50, and an integral compressor exhaust manifold 57 provides a passage from the compression chamber 50 to the compressor outlet port 26. Corresponding integral turbine inlet and exhaust manifolds 58, 59 are provided on the turbine side 22 of housing 18. Thus, air entering compression chamber 50 from manifold 56 is compressed by vanes 40 through the decreasing volume of compression chamber 50 to the compressor outlet manifold 57. Similarly, compressed gas entering expansion chamber 52 from manifold 58 is expanded as it is carried by vanes 40 to the turbine exhaust manifold 59.

It is desirable for the vanes 40 to freely slide inward or outward in slots 44 so as to stay always in sealing contact with the inner surface 48 of housing 18. A problem with prior art sliding-vane type compressors is that the sliding motion of the vanes can be inhibited as a result of pressure changes induced in the slot bottoms. For example, when the vane moves outward under the influence of centrifugal force, that movement is resisted by a resulting vacuum drawn in the slot bottom. Also, when the vane is approaching an outlet and being pushed back into the slot 42 by housing wall 48, a phenomenon occurs whereby the vane compresses the air in pocket 44, resisting further inward motion of the vane.

Figure 3:
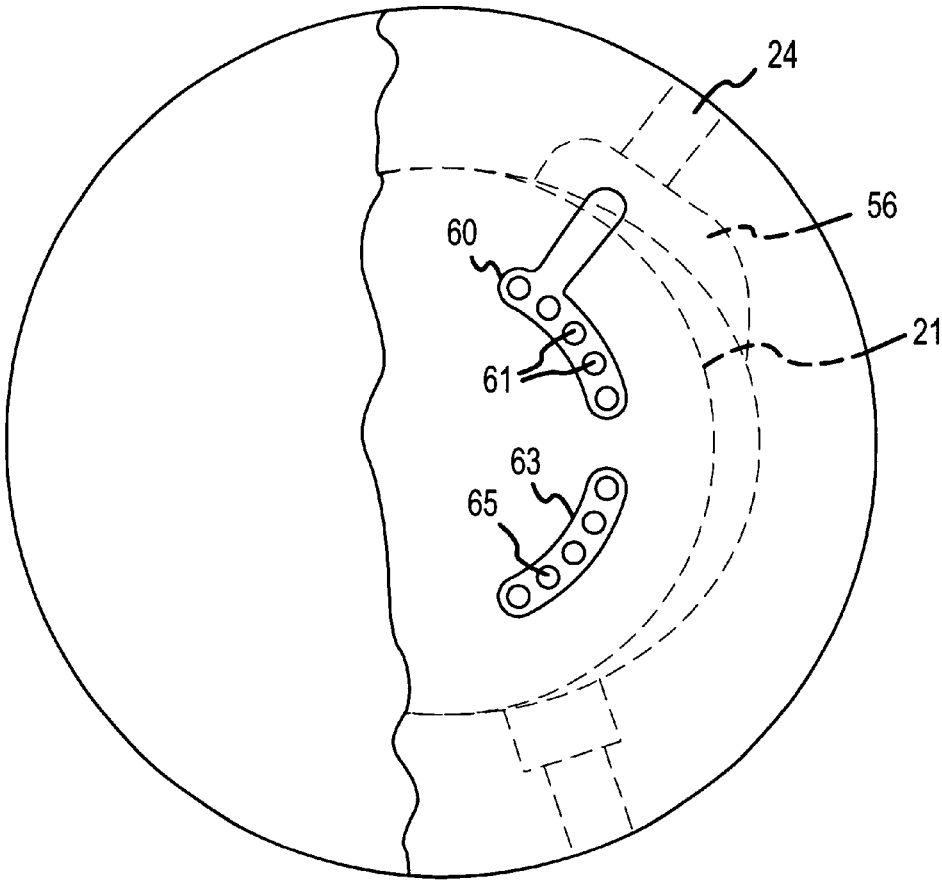
FIG. 3 is a partial cross-sectional view of an exemplary unitary sliding vane type compressor-expander showing an exemplary passage for venting the vane slot bottoms.

In a preferred embodiment of the present invention the pockets 44 at the base of slots 42 are vented to allow the vanes to move freely without resistance from relatively low or high pressure within the slot bottom. In one embodiment, the bases of the vanes are vented to an intake or an outlet of housing 18. As shown for example in FIG. 3, this may be accomplished by forming a channel 60 on the inner surface of cover plate 31, and a corresponding slot (not shown) or a plurality of apertures 61 through seal plate 21 aligned with channel 60. The channel 60 also extends to the intake manifold 56 as shown in FIG. 3. The apertures 61 and channel 60 are positioned at a radius to align with the pockets 44 of slots 40, thereby placing each pocket in fluid communication with the channel 60 and the intake manifold 56. The circumferential span of channel 60 and apertures 61 is preferably sufficient in the example embodiment shown to allow the slot bottoms to vent to the manifold 56 until the vanes pass the end of the manifold 56.

It will be appreciated that similar venting arrangements to the one described above could be used at other circumferential locations on the compressor-expander. For example, a channel 63 and apertures 65 as also shown in FIG. 3 could be used to vent the slot bottoms as the vanes approach the outlet manifold 57. In such an application, the channel may be configured as shown to vent the slot bottoms only to one another, or alternatively extended so as to vent the slot bottoms to an intake or outlet manifold, or to another channel. Moreover, one skilled in the art will appreciate that various additional arrangements of channels and apertures, and interconnections therebetween, may be utilized to preferentially affect the slot bottom pressures.

Figure 4A:
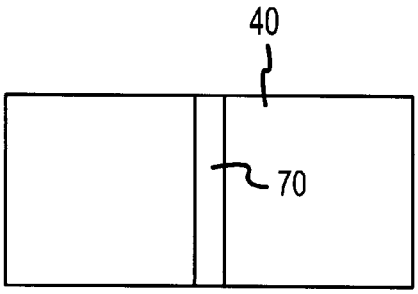
FIG. 4 is a cross-sectional view of a portion of the rotor of a compressor-expander in accordance with the present invention showing grooves in the vane and rotor slot for venting the slot bottoms.
Figure 4:
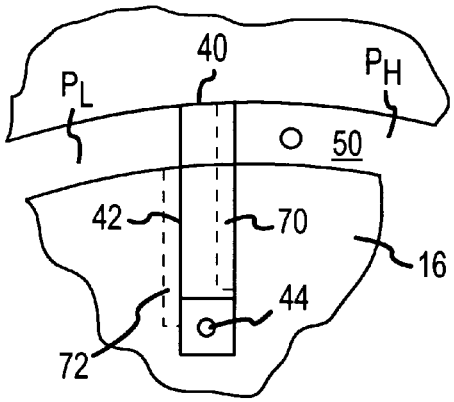

In another venting arrangement, the slot bottoms 44 may be vented by providing a passage directly from the chambers 50 or 52 to the slot bottoms. Referring now to FIG. 4, a slot 70 is formed on one side of the vane 40, extending the full height, or nearly the full height of the vane from the slot bottom end to the vane tip. The slot 70 thus provides a fluid passage from the slot bottom 44 to, for example, the compression chamber 50. In the embodiment shown, the slot 70 is on the high pressure side of vane 40, and thus allows high pressure air to enter slot bottom 44. Such an arrangement may be useful where it is desirable to primarily assist with the extension of the vanes 40. Alternatively, the slot 70 may be formed on the low pressure side of the vane 40, thereby allowing the slot bottom 44 to vent to a lower pressure. Such an arrangement could be used where it is desirable to primarily assist with the retraction of the vanes 40.

A groove 72 in the vane slot 42 may also be used instead of, or in conjunction with a slot 70 in the vane 40 to vent the slot bottoms 44. The groove 72 may also be on either the high-pressure or low-pressure side of the vane slot 42 as desired. The groove 72 may extend the full depth of slot 42, or stop short of the bottom of pocket 44. In the latter case, the slot bottom is vented only when the vane is extended far enough to expose the groove, as shown in FIG. 4.

Figure 6:
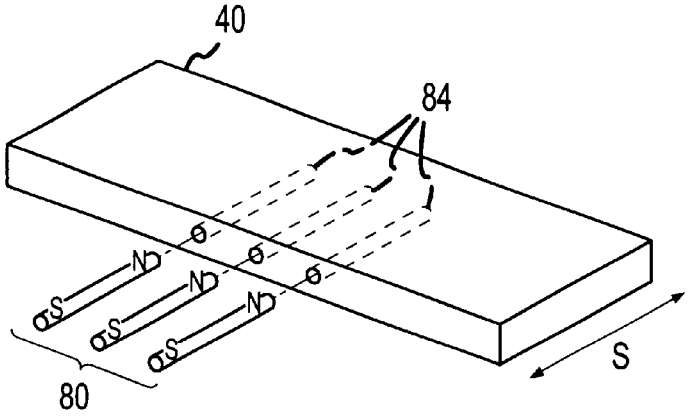
FIG. 6 is a perspective view of a single rotor vane of the unitary compressor-expander showing a preferred placement of the vane magnets.
Figure 5:
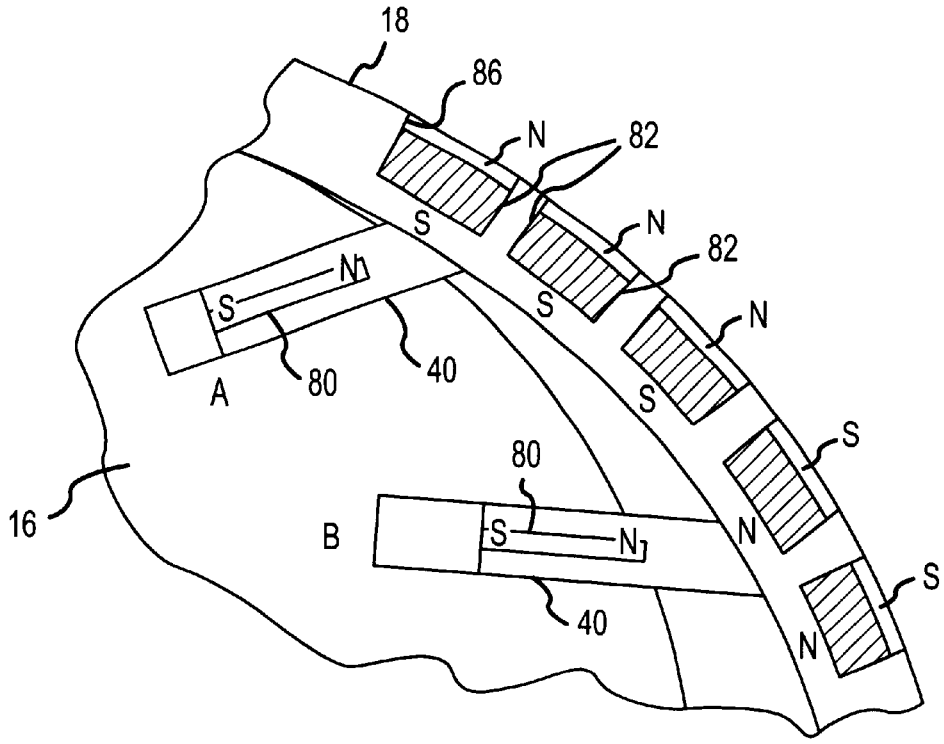
FIG. 5 is a cross-sectional view of a portion of a sliding vane type compressor-expander of the present invention showing magnets in the vanes and housing.

In another embodiment of the invention, strategically placed permanent magnets are used to positively assist with the extension or retraction of the vanes 40. Referring to FIG. 5, at least one vane magnet 80 is disposed within each vane 44, and a plurality of stationary magnets 82 are mounted in the housing 18 along the path of vanes 44. As better seen in FIG. 6, the vane magnets 80 are preferably cylindrical in shape with poles at each end, and sized to fit within a hole 84 drilled in the vane. The hole 84 is drilled substantially along the direction of sliding motion of the vanes 44, indicated by arrow S. One or more vane magnets 80 may be used per vane 40 as needed, and preferably three are used as shown in FIG. 6. The stationary magnets are also preferably cylindrical in shape with poles at each end, and mounted in holes 86 drilled into the housing 18, although other shapes of magnets may work equally well.

The vane and stationary magnets can be oriented to attract or repel one another as needed. In a preferred embodiment of the invention, the vane magnets are all oriented in the same way, as for example with the north pole of each magnet toward the end of the vane that contacts the housing. The stationary magnets 82 may then be strategically oriented to attract or repel the vane magnets and thus the vanes as they sweep past, and thereby assist the desired sliding movement of the vane. For example, as shown in FIG. 5, the north pole of the vane magnet at the location indicated by the letter A is positioned to attract the south poles of the nearby stationary magnets 82, and cause the vane 40 to be pulled toward the housing 18. Conversely, an opposing force is generated between the north pole of the vane magnet at location B and the adjacent north poles of the nearby stationary magnets 82, thereby pushing on the vane 40 in a direction away from the housing 18. The magnets are thus used in the foregoing example to assist with the extension of the vanes at location A and with the retraction of the vanes at location B. Moreover, through preferential sizing and arrangement of the magnets, an optimal level of contact force between the vanes and housing can be maintained around the entire contact path.

In another embodiment of the invention, ferrous metal inserts (not shown) are placed in the vanes 40 instead of the vane magnets 80. The metal inserts cause the vane to be attracted by the housing magnets 82, and pulled toward the housing 18 wherever is the magnets 82 are located. However, unlike the above described embodiment using vane magnets, a repelling force cannot be generated between the housing magnets 82 and the ferrous inserts, and thus the vanes cannot be actively pushed away from the housing. An advantage of using the ferrous inserts instead of vane magnets is that efficiency losses caused by the generation of electrical eddy currents are greatly reduced. Eddy currents can be further reduced by making the rotor 16 from a metal with low electrical conductivity, such as stainless steel. Accordingly, the size of the magnets or ferrous metal inserts used in the vanes can be increased without increasing overall electrical losses.

Figure 7:
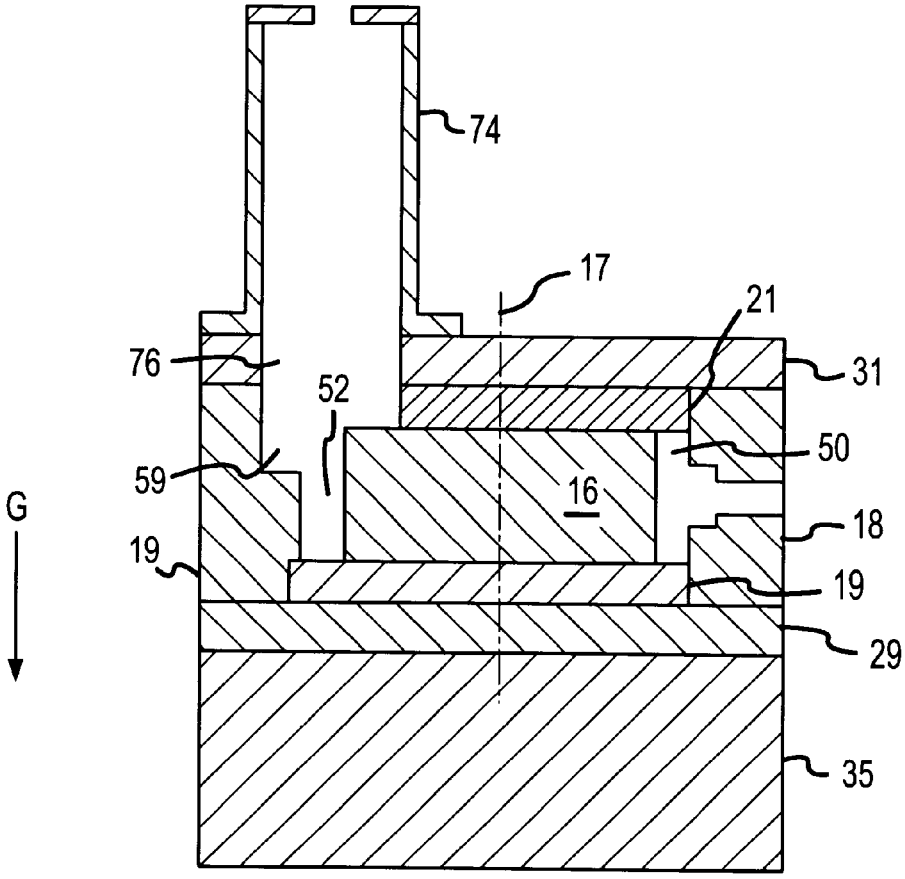
FIG. 7 is a cross-sectional view of a unitary compressor-expander in accordance with the present invention showing an integral condenser-humidifier spout.

In a preferred embodiment of the invention an integral condenser and humidifier is provided. Referring now to FIG. 7, a turbine exhaust condenser spout 74 extends in a substantially vertical direction with respect to gravity (indicated by arrow G) from the turbine exhaust portion of the housing 18. A passage 76 through the cover plate 31 and housing 18 provides a flow-path from the condenser spout 74 to the exhaust outlet manifold 59 and expansion chamber 52. It should be understood that the turbine exhaust port 30 shown in FIGS. 1 and 2 would be either bypassed or capped off in the embodiment shown in FIG. 7 to force the exhaust through passage 76 and spout 74. In the embodiment of FIG. 7 the compressor-expander 12 is mounted for operation such that the axis of rotation 17 of rotor 16 is oriented vertically (that is in the direction of gravity) as indicated by the arrow G. The condenser spout 74 is also substantially vertical and aligned with gravity.

The condenser spout 74 and passage 76 are preferably large enough to provide for condensation of the water vapor in the spout 74, and a low enough exhaust velocity to prevent the water that has condensed from being blown out of the spout. More specifically, the internal diameter of the spout 74 should be sized such that the exhaust gas flow velocity is less than about 5 feet per second (fps), and preferably about 3 fps. The length of the condenser spout should be preferably between about 3 and 7 times the internal diameter of the spout, and preferably about 5 times the diameter. The passage 76 is also sized such that the velocity of the exhaust gasses within is low enough to allow condensed water to flow to manifold 59. Preferably the cross-sectional area of passage 76 is at least as large as the cross-sectional area of manifold 59 to prevent acceleration of the exhaust gas.

In the case of different mounting orientations of the compressor-expander 12, the condenser spout 74 is repositioned to be inclined from the horizontal, and preferably again in a substantially vertical orientation. For example, if the compressor axis 17 were horizontal (perpendicular to gravity), then a vertical spout 74 would preferably extend from the top of the housing 18 as depicted in FIG. 1. In that case the turbine exhaust port 30 would provide a direct flow path from the condenser spout 74 to the exhaust manifold 59. It will be appreciated that the turbine exhaust port 30 in this embodiment would be sized so as to not constrict the airflow between manifold 59 and spout 74. An adjustable spout may be used for installations in which the compressor-expander 12 can have various orientations. An adjustable spout can include a flexible joint, a rotating or universal type joint, or any other device for facilitating repositioning of the spout 74 to a vertical orientation.

In operation, water contained in the expanded exhaust gas condenses on the inner surfaces of the condenser spout 74, and under the influence of gravity flows back down the spout opposite the direction of the exhaust flow. The condensed water flows from the spout 74, through the passage 76, back into the manifold 59 of compressor-expander 12, and into the path of the vanes 40 of rotor 16. The water is then carried by the vanes 40 into the compressor side 20 of compressor-expander 12, thereby humidifying the compressed air, and lubricating and sealing the moving and contacting portions of the compressor-expander. It will be appreciated that the operating efficiency of the compressor-expander is thereby substantially improved. Thus the condenser spout 74 provides an integral condenser and humidifier that is far simpler in construction and lighter in weight than prior art external condenser and humidifier systems.

Figure 8:
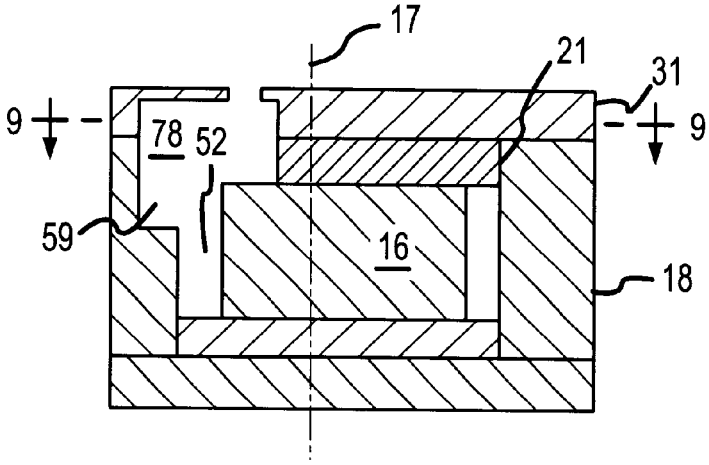
FIG. 8 is a cross-sectional view of a unitary compressor-expander in accordance with the present invention showing an integral condenser-humidifier chamber.
Figure 9:
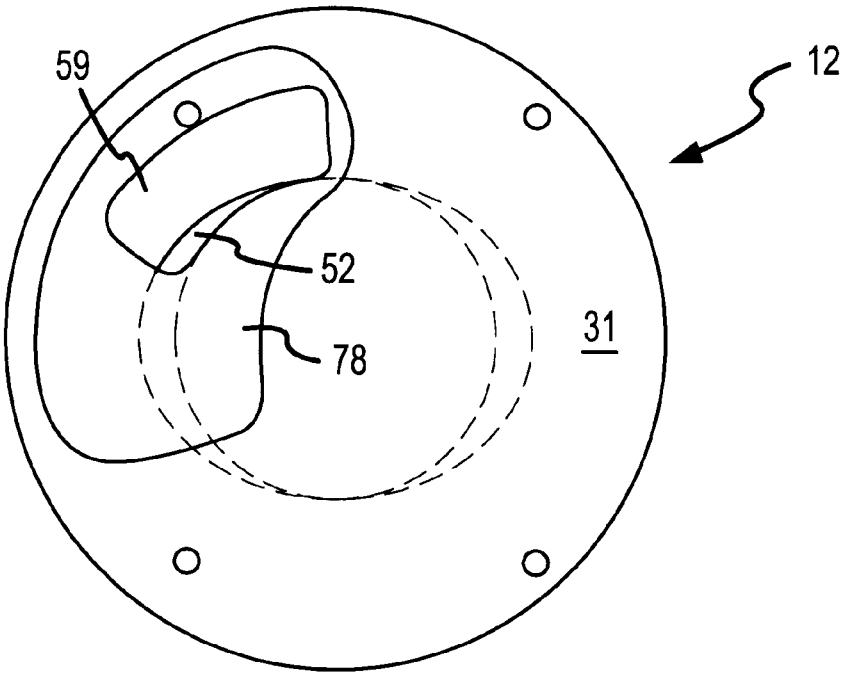
FIG. 9 is a different cross-sectional view of the compressor-expander of FIG.8 showing the integral condenser-humidifier chamber.

Another embodiment of the integral condenser-humidifier in accordance with the present invention is shown in FIGS. 8 and 9. In this embodiment, an integral condensing chamber 78 is formed within the compressor-expander 12. The condensing chamber 78 is formed by hollowing out portions of the seal plate 21 and the cover plate 31 adjacent manifold 59. As shown in FIG. 9, the chamber 78 can extend over a relatively large region of the compressor-expander 12 as needed to create sufficient volume and surface area for good condensation. The condensing chamber 78 operates in the same manner as the condenser spout embodiment, by providing a sufficiently large volume with sufficient surface area wherein the exhaust gas can move slowly through and condense out water on the internal walls. The condensed water then re-enters the compressor-expander under the influence of gravity through the exhaust manifold 59.

Figure 10:
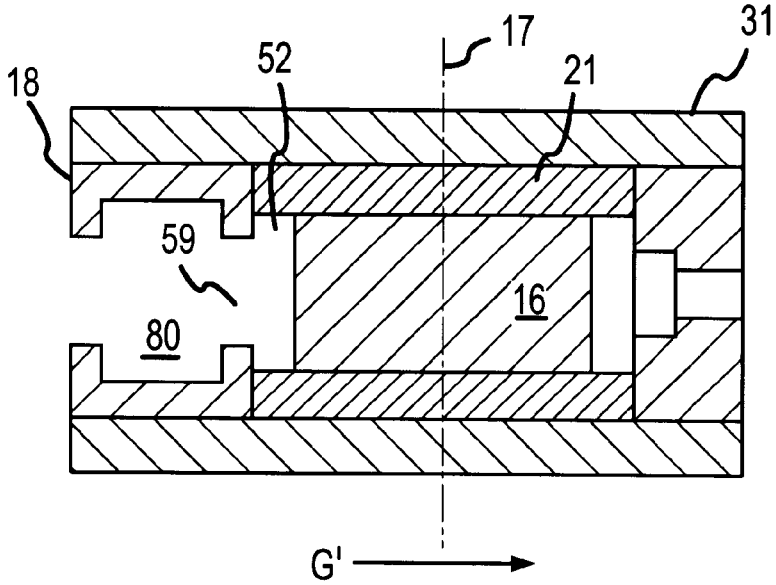
FIG. 10 is a cross-sectional view of a unitary compressor-expander in accordance with the present invention showing another embodiment of an integral condenser-humidifier chamber.

It will be appreciated that the condensing chamber need not be positioned precisely as shown in FIG. 8, and in fact other placements and orientations may be preferable, particularly for different orientations of the compressor-expander 12 with respect to gravity. For example, in another embodiment of the present invention shown in FIG. 10, the compressor-expander 12 is oriented such that the axis of rotation 17 of rotor 16 is perpendicular to gravity (indicated by arrow G'). A condensing chamber 80 is provided in housing 18 directly outboard of the location of the exhaust manifold 59. In this embodiment the exhaust manifold 59 provides a direct water flow-path from the chamber 80 to the rotor 16.

Figure 11:
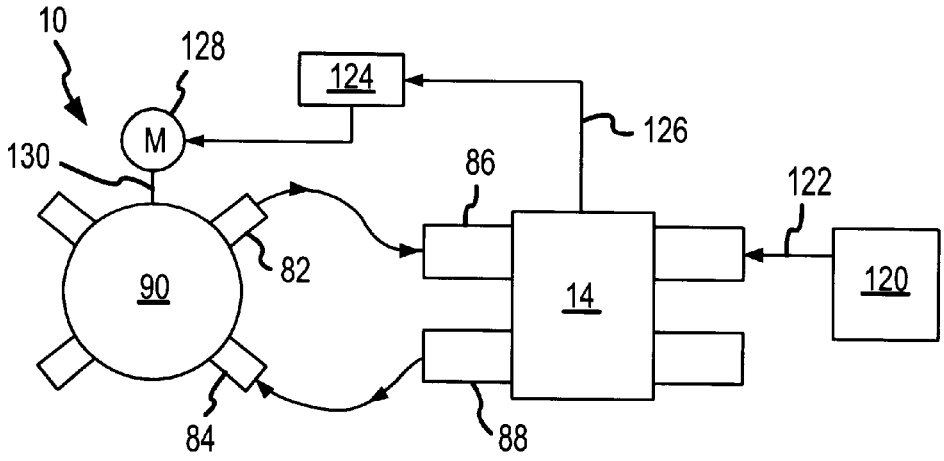
FIG. 11 is a schematic drawing of an electrical generation system comprising a unitary sliding vane type compressor-expander in combination with a fuel cell.

In yet another embodiment of the present invention a unitary sliding vane type compressor-expander is used in combination with a hydrogen fuel cell 14 as part of an electrical generation system 10, as shown in FIG. 11. In the exemplary electrical generation system 10 of FIG. 11, the compressor outlet port 82 of a unitary sliding-vane-type compressor expander 90 is connected to the oxidant inlet 86 of the fuel cell 14, and the oxidant exhaust 88 of fuel cell 14 is connected to the expander inlet port 84 of compressor-expander 90. Thus, the fuel cell 14 is supplied with compressed air from the compressor portion of the compressor-expander 90, and the spent oxidant exhaust from the fuel cell 14 is expanded across the expander portion of compressor-expander 90.

The system 10 also includes a fuel supply 120 and a fuel supply line 122 to an anode portion of the fuel cell 14. A portion of the electricity generated by the fuel cell is used to power a motor that drives the compressor-expander 90. As depicted in FIG. 11, an electrical cable 126 from fuel cell 14 passes through a suitable controller 124 and to a motor 128 connected by a shaft 130 to the compressor-expander 90. Although shown as a separate component in schematic drawing FIG. 11, it will be appreciated that in a preferred embodiment of the invention the motor 128 is integral with or mounted directly onto the compressor-expander, as shown for example in FIG. 2. The unitary compressor-expander 90 is preferably constructed in accordance with the embodiment of compressor-expander 12 of FIG. 1. In that case, the compressor-expander 90 may advantageously incorporate the unique features described above, and in particular an integral condenser-humidifier to lubricate the compressor-expander and humidify the compressed air being directed to the fuel cell 14. A further advantage is thus realized in that the operating efficiency of the fuel cell is also substantially improved by the introduction of the humidified inlet air. It will be appreciated by one skilled in the art that even without a dedicated condensation chamber, a certain amount of condensation occurs within the expansion chamber, and the exhaust manifold and port of the unitary compressor-expander of FIG. 1. Such condensation may be significant enough to allow for reducing the size of, or even eliminating the dedicated condensation chamber, particularly in the presently described embodiment of the invention where the air entering the expander portion has been pre-humidified by the fuel cell.

Figure 12:
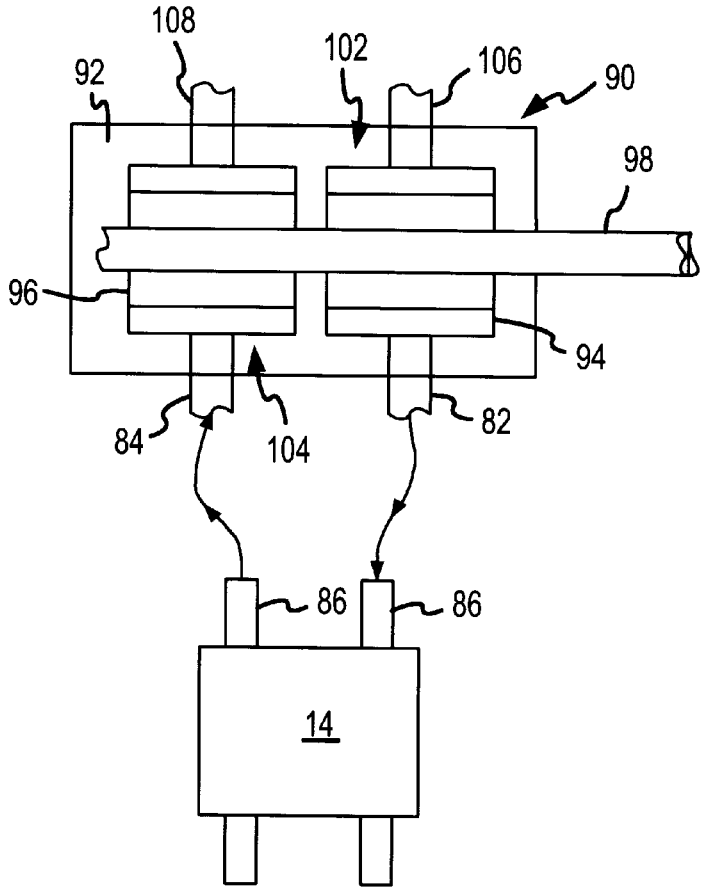
FIG. 12 is a schematic drawing of an embodiment of the electrical generation system of FIG. 11 including a cross-sectional view of an alternative unitary sliding vane type compressor-expander in combination with a fuel cell.

Alternatively, a unitary sliding-vane type compressor-expander 90 could be configured to have separate compressor and expander rotors operating in separate housing chambers and driven by a common shaft as shown in FIG. 12. The compressor-expander 90 of FIG. 12 includes a housing 92 defining a compressor section 102 with inlet and outlet ports 106, 82, and an expander section 104 with inlet and outlet ports 84, 108. A compressor rotor 94 and expander rotor 96 both mounted for rotation on a common shaft 98, are respectively disposed in the housing sections 102 and 104. Similarly for this embodiment of a unitary compressor-expander, the compressor exhaust port 82 and expander inlet port 84 are connected to the fuel cell oxidant inlet and exhaust as shown in FIG. 11.

EXAMPLE

The applicant has constructed and tested a small size unitary sliding-vane type compressor-expander in accordance with the present invention. The compressor-expander was configured generally in accordance with the embodiment of FIG. 1, and designed to supply between 0.3 and 0.9 SCFM air flow. System operating efficiency was compared in back-to-back tests performed with and without the introduction of water into the compressor portion of the compressor-expander. In the test performed with water, the water was sprayed directly into the inlet of the compressor.

Listed below are the relevant system design and operational parameters for the tests performed:

Compressor-Expander:

Single Rotor type 8 vanes at 20 deg. incidence angle

Vane material: Solid graphite

Rotor diameter=1.6 in.

Built in pressure ratio=1.7 (ratio of inlet volume of compressor to exhaust volume of compressor)

Compression ratio=1.47

Volume flow at 2,700 RPM=0.6 SCFM

Motor Type: Brushless, D.C.

Motor Size=0.15 h.p., at 6 amps

Figure 13:
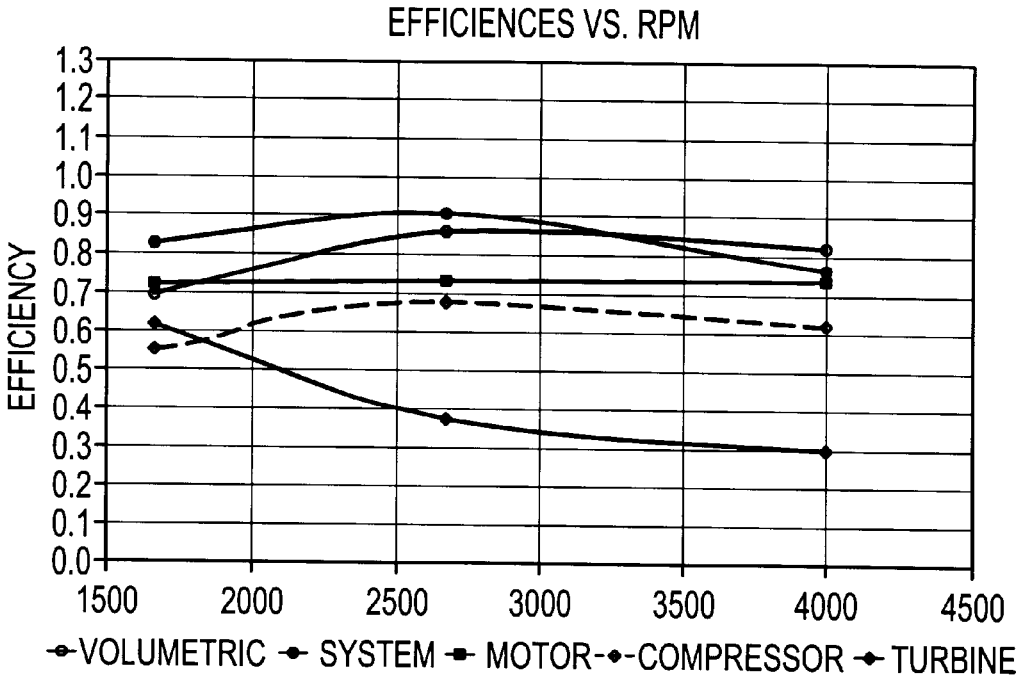
FIG. 13 is a graph showing the efficiency of an electrical generation system in accordance with the present invention, operated in a dry mode.
Figure 14:
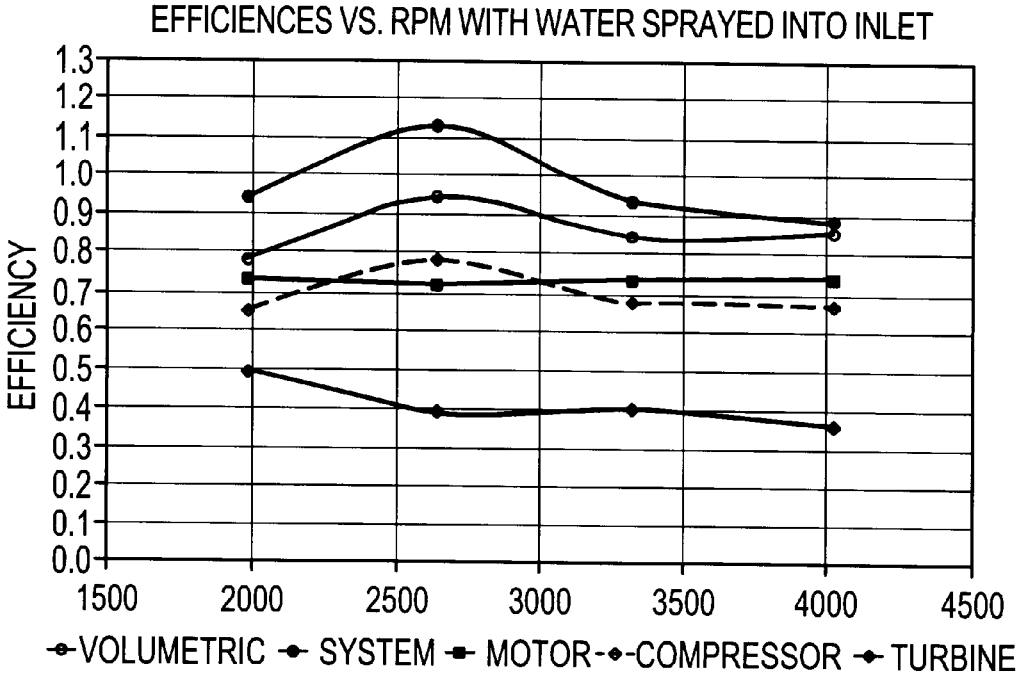
FIG. 14 is a graph showing the efficiency of an electrical generation system in accordance with the present invention, operated in a wet mode.

A useful measure of system performance is the "effective compressive efficiency", which is the efficiency that would be required for a compressor working alone to achieve the same overall performance. In other words, the effective compressive efficiency is defined as the calculated power required to isentropically compress the measured mass flow to the measured pressure ratio divided by the actual shaft input power. The efficiency of the system, known as the "effective compressive efficiency" was calculated both with and without the water sprayed into the inlet. FIGS. 13 and 14 are graphs showing effective compressive efficiency vs. RPM of the rotor. FIG. 13 displays the results without water spray, and FIG. 14 is with the inlet water spray. As evident from the graphs, overall system efficiency is very high, and with the water spray on, system compressive efficiency is greater than one.

Having thus described a preferred embodiment of a unitary sliding vane type compressor-expander and electrical generation system, it should now be apparent to those skilled in the art that certain advantages of the system have been achieved. It should also be appreciated by those skilled in the art that various modifications, adaptations, and alternative embodiments thereof may be made within the scope and spirit of the present invention. The present invention is further defined by the following claims.

What is claimed is:

1. A fuel cell electrical generation system comprising:

a unitary sliding vane type compressor-expander for improving the efficiency of the system, comprising:

a housing having a compressor side with a compressor inlet port and a compressor outlet port, and an expander side with an expander inlet port and an expander outlet port;

a cylindrical rotor disposed within the housing and having a plurality sliding vanes disposed in slots around an outer periphery thereof, wherein the vanes are configured to slide inward and outward along the slots upon rotation of the rotor, thereby maintaining contact with an inner contoured surface of the housing and simultaneously compressing oxidant gas on the compressor side of the housing and expanding oxidant gas on the expander side of the housing;

a fuel cell for generating output electrical power having an oxidant inlet connected to the compressor outlet port of the compressor-expander for receiving pre-compressed oxidant gas therefrom, an oxidant outlet connected to the expander inlet port of the compressor-expander for exhausting compressed oxidant thereto, a fuel inlet for introducing fuel to react with the oxidant gas, and a fuel exhaust for exhausting reacted fuel;

a motor, powered by electricity derived from the fuel cell electrical generation system, having an output shaft connected to the cylindrical rotor of the compressor-expander for rotationally driving the cylindrical rotor to cause the simultaneous compression and expansion of oxidant gas in the compressor-expander.

2. The fuel cell electrical generation system of claim 1, wherein the bottoms of the vane slots are vented.

3. The fuel cell electrical generation system of claim 2, wherein the bottom of one vane slot is vented to the bottom of at least one other vane slot.

4. The electrical generation system of claim 3, wherein the bottom of at least one vane slot is vented to at least one of the inlet and outlet ports.

5. The fuel cell electrical generation system of claim 1, further comprising an integral exhaust gas condenser-humidifier.

6. The fuel cell electrical generation system of claim 5, wherein the integral condenser comprises one of a vertically oriented spout, or an internal chamber.

7. The fuel cell electrical generation system of claim 1, further comprising:

a permanent magnet in at least one of the vanes; and at least one stationary magnet in the housing.

8. The fuel cell electrical generation system of claim 1, wherein the compressor-expander housing is made of a material selected from the group consisting of: stainless steel, aluminum, aluminum with an anodize coating, aluminum with a TEFLON impregnated anodize coating, or ceramic.

9. The fuel cell electrical generation system of claim 1, wherein the compressor-expander rotor is made of a material selected from the group consisting of: stainless steel, aluminum, aluminum with an anodize coating, aluminum with a TEFLON impregnated anodize coating, or ceramic.

10. A unitary sliding vane type compressor-expander, comprising:

a compressor portion with a compressor inlet and a compressor outlet; an expander portion with an expander inlet and an expander outlet; and an integral condenser-humidifier disposed in fluid communication with the expander outlet for condensing water out of the expanded gas and returning the condensed water directly to the expander outlet.

11. The compressor expander of claim 10, further comprising:

a housing; and a single rotor with a plurality of sliding vanes in slots defining in cooperation with the housing a compression chamber in the compressor portion and an expansion chamber in the expander portion of the compressor-expander.

12. The unitary compressor-expander of claim 11, wherein the bottom of the vane slots in the rotor are vented.

13. The unitary compressor-expander of claim 12, wherein the bottom of at least one slot is vented to the compression chamber.

14. The unitary compressor-expander of claim 12, wherein the bottom of the vane slots are vented through a groove between the face of the vane and the slot.

15. The unitary compressor-expander of claim 11, wherein the bottom of at least one vane slot is vented to at least one of the inlet and outlet ports.

16. The unitary compressor-expander of claim 11, further comprising:

a permanent magnet in at least one of the vanes; and at least one stationary magnet in the housing.

17. The compressor-expander of claim 11, wherein the housing is made of a material selected from the group consisting of: stainless steel; aluminum; aluminum with an anodize coating; aluminum with a TEFLON impregnated anodize coating; or ceramic.

18. The compressor-expander of claim 11, wherein the rotor is made of a material selected from the group consisting of: stainless steel; aluminum; aluminum with an anodize coating; aluminum with a TEFLON impregnated anodize coating; or ceramic.

19. The unitary compressor-expander of claim 10, wherein the integral condenser is configured to allow condensed water to drain under the influence of gravity into the path of the vanes at the expander outlet.

20. The unitary compressor-expander of claim 10, wherein the integral condenser comprises a substantially vertical spout.

21. The unitary compressor-expander of claim 20, wherein the orientation of the vertical spout is adjustable relative to the compressor-expander.

22. The unitary compressor-expander of claim 10, wherein the integral condenser comprises an internal chamber.

23. A unitary compressor-expander comprising:

a housing having a compressor side with a compressor inlet and a compressor outlet, and an expander side with an expander inlet and an expander outlet;

a cylindrical rotor disposed within the housing and having a plurality sliding vanes disposed in slots around an outer periphery thereof, wherein the vanes are configured to slide outwardly along the slots upon rotation of the rotor, and sealingly contact an inner contoured surface of the housing;

a vane magnet in at least one of the vanes;

at least one stationary magnet in the housing disposed about the inner contacting surface, wherein the poles of the vane magnet are substantially aligned with the direction of the vane and its corresponding slot, and the poles of the at least one stationary magnet are substantially aligned with the vanes and slots as they pass by the stationary magnet, wherein a first one of said at least one stationary magnets is oriented to repel the vane magnet, and a second one of said at least one stationary magnets is oriented to attract the vane magnet.

24. A method for improving the efficiency of a fuel cell electrical generation system, comprising the steps of:

providing a fuel cell for generating output electrical power having an oxidant inlet, an oxidant outlet, a fuel inlet, and a fuel exhaust;

connecting a unitary vane type compressor-expander to the fuel cell, comprising:

a housing having a compressor side with a compressor inlet port and a compressor outlet port, and an expander side with an expander inlet port and an expander outlet port;

a cylindrical rotor disposed within the housing and having a plurality sliding vanes disposed in slots around an outer periphery thereof, wherein the vanes are configured to slide inward and outward along the slots upon rotation of the rotor, thereby maintaining contact with an inner contoured surface of the housing and simultaneously compressing oxidant gas on the compressor side of the housing and expanding oxidant gas on the expander side of the housing;

driving the unitary compressor expander with a motor, powered by electricity derived from the fuel cell electrical generation system, by means of an output shaft of the motor connected to the cylindrical rotor of the compressor-expander for rotationally driving the cylindrical rotor;

compressing air drawn from the compressor inlet on in the compressor side of the compressor-expander;

supplying the compressed air to an oxidant inlet of the fuel cell for reacting with fuel introduced through the fuel inlet; and expanding the spent oxidant gas from the fuel cell across the expander side of the compressor-expander.

25. The method of claim 24, further comprising the steps of:

condensing water out of the expanded exhaust gas; and carrying at least a portion of the condensed water by rotation of the rotor, across into the compressor side of the compressor-expander.

26. The method of claim 25, further comprising the step of providing a substantially vertical spout for performing the step of condensing water out of the expanded exhaust gas.

27. The method of claim 25, further comprising the step of providing an internal condensing chamber in the path of the expanded exhaust gas for performing the condensing step.

* * * * *